United States Patent [19]

Mathiesen et al.

[11] Patent Number: 4,549,881

[45] **Date of Patent: * Oct. 29, 1985**

[54] AQUEOUS SLURRY OF A SOLID FUEL AND A PROCESS AND MEANS FOR THE PRODUCTION THEREOF

[75] Inventors: Mait M. Mathiesen, Arild; Lars I. Gillberg, Lund; Karl M. E. Hellsten, ÖdsmÅl; Gunvor B. T. Karlsson, Stenungsund, all of Sweden

[73] Assignees: Ab Carbogel, Helsingborg; Berol Kemi Ab, Stenungsund, both of Sweden

[ * ] Notice: The portion of the term of this patent subsequent to Jan. 29, 2002 has been disclaimed.

[21] Appl. No.: 492,197

[22] Filed: May 6, 1983

[30] Foreign Application Priority Data

May 7, 1982 [SE] Sweden ..... 8202879

[51] Int. Cl.[4] ..... C10L 1/32

[52] U.S. Cl. ..... 44/51; 44/70; 44/75; 44/76; 252/351

[58] Field of Search ..... 44/51, 70, 75, 76; 406/47, 49, 197, 195; 252/351

[56] References Cited

U.S. PATENT DOCUMENTS

| | | | |
|---|---|---|---|
| 2,346,151 | 4/1944 | Burk | 44/51 |
| 2,359,325 | 10/1944 | McConnell | 44/51 |
| 2,652,341 | 9/1953 | Craig | 252/357 |
| 3,168,350 | 2/1965 | Phinney | 44/51 |
| 3,524,682 | 8/1970 | Booth | 302/66 |
| 3,762,887 | 10/1973 | Clancey et al. | 44/51 |
| 4,076,505 | 2/1978 | Dessau | 44/1 R |
| 4,094,810 | 6/1978 | Thomas | 44/51 |
| 4,099,537 | 7/1978 | Kalfoglou et al. | 252/353 |
| 4,162,044 | 7/1979 | Manfroy | 241/16 |
| 4,162,045 | 7/1979 | Katzer | 241/16 |
| 4,217,109 | 8/1980 | Siwersson | 44/51 |
| 4,242,098 | 12/1980 | Braun et al. | 44/51 |
| 4,302,212 | 11/1981 | Yamamura et al. | 44/51 |
| 4,358,293 | 11/1982 | Mark | 44/51 |
| 4,470,828 | 9/1984 | Yamamura | 44/51 |

FOREIGN PATENT DOCUMENTS

| | | |
|---|---|---|
| 0050412 | 4/1982 | European Pat. Off. . |
| 1526174 | 3/1970 | Fed. Rep. of Germany . |
| 3121979 | 12/1982 | Fed. Rep. of Germany . |
| 82031535 | 11/1982 | Sweden . |
| 1522575 | 8/1978 | United Kingdom . |
| 1600865 | 10/1981 | United Kingdom . |

OTHER PUBLICATIONS

Kirk-Othmer "Encyclopedia of Chemical Technology", Second Edition (1969), vol. 19, p. 527.

*Primary Examiner*—William R. Dixon, Jr.
*Assistant Examiner*—Margaret B. Medley
*Attorney, Agent, or Firm*—Gordon W. Hueschen

[57] ABSTRACT

An aqueous slurry of a solid fuel and a process and a means for producing said slurry are described. The aqueous slurry comprises a highly concentrated slurry of a pulverized, carbonaceous material having a particle size of at most 0.5 mm, and 0.02–2% by weight of at least two surface active additives. The solids content of the slurry is 65–90% by weight, preferably 70–80% by weight. The slurry is characterized in that the surface active additives include, as a major part, a water-soluble nonionic surface active agent which is an alkylene oxide adduct with a hydrophobic part and a hydrophilic part, said hydrophilic part consisting of at least one polyalkylene oxide chain with a length of at least 40, preferably 50–150 ethylene oxide units; and, as a minor part, an ionic surface active agent.

The ionic surface active agent preferably has the general formula:

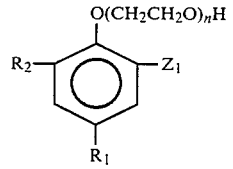

(IX)

wherein $R_1$ and $R_2$ are hydrogen or an alkyl group with 1–22 carbon atoms, provided that the sum of the number of carbon atoms of $R_1$ and $R_2$ is at least 6, and $Z_1$ designates the group $—SO_3H$, $—CH_2{+}NHR_3R_4X^-$ or $—CH_2{+}NR_3R_4R_5X^-$, wherein $R_3$, $R_4$ and $R_5$ are alkyl and/or hydroxyalkyl groups with 1–4 carbon atoms and X is an anion, and n is 40–200.

17 Claims, No Drawings

AQUEOUS SLURRY OF A SOLID FUEL AND A PROCESS AND MEANS FOR THE PRODUCTION THEREOF

The present invention relates to an aqueous slurry of a solid fuel in the form of a pulverized carbonaceous material and one nonionic and one ionic surface active additive. The invention also relates to a process and a means for producing such aqueous slurry.

The term "solid fuel" as used in the context of this invention comprises different types of carbonaceous materials, such as bituminous, anthracitic, sub-bituminous and lignitic coal, charcoal, petroleum coke or other solid refinery by-products, or mixtures thereof.

Present-day heat production is largely based on the combustion of liquid or gaseous fuels, and existing plants therefore are adapted to the transport, storage and combustion of fuel in these physical forms. Transition to lump coal would involve extensive reconstruction and new investments, and it therefore is a matter of course that a keen interest has been shown in different processes for converting coal into liquid or gaseous fuel products. In addition to a chemical conversion of coal into methanol or hydrocarbons, it has also been proposed to produce a slurry of coal powder in different liquids, such as methanol, oil, mixtures of water and oil, or water alone. Of these alternatives, a slurry of coal and water offers far greater practical and economic advantages than the others, primarily because this slurry has a high flash-point and that the raw material costs for the liquid carrier medium will be low.

Many demands are made on a coal/water slurry, but the most important requirement is that the slurry have a high carbon content and be homogeneous also after it has been stored for some time. Furthermore, it is important that the viscosity of the slurry be low to facilitate pumping and fine division of the slurry in the combustion chamber. The slurry must also have a low sensitivity to pH variations as well as a low corrosivity towards tanks, pipelines, pumps and nozzles.

It is already known to produce slurries of pulverized solid fuels and to stabilize these slurries in a greater or less degree by means of various additives. An example of prior-art technique is U.S. Pat. No. 4,217,109 which discloses a coal/water slurry containing a dispersant which, by selective adsorption, causes coal particles and particles of other material to be charged differently, whereby purification of the coal and also stabilization of the suspension is facilitated. The dispersant according to the U.S. patent specification is selected among polyelectrolytes or polyphosphates.

Moreover, it is already known from the published PCT application PCT/US80/01419 to produce a highly concentrated slurry of coal in water by controlling the particle size distribution of the coal in a specific manner and to add surface active chemicals imparting a specific surface charge to the coal particles. The surface active chemicals employed are commercially available dispersants. The characteristics of the slurry are highly dependent upon a combination of an exact particle size distribution and the surface charge of the individual particles, which is achieved by adding exact amounts of dispersant. In actual practice, however, it is extremely difficult to reproducibly achieve, on a commercial scale, the required exact particle size distribution, or to maintain the characteristics of the slurry at an increasing ionic contamination of the slurry due to, for example corrosion of the equipment or leaching of the coal.

In addition, it is already known from French patent specification No. 1,308,112 to cause a viscosity reduction of low-concentrated coal suspensions by using an alkylene oxide adduct in which the hydrophilic part preferably consists of 5–35 ethylene oxide units.

British patent specification No. 1,429,934 concerns a process of dispersing a particulate material in a liquid by means of a block copolymer made up of blocks which are, respectively, soluble and insoluble in the liquid. Poly(t-butyl styrene) is mentioned as an example of a soluble block. The particulate material is highly fine-grained and, preferably, has a particle size of from 50 Å to 10 μm. One example of particulate material is carbon black.

U.S. Pat. No. 4,358,293, published on Nov. 9, 1982 and the corresponding EPC application No. 82300448.6, Publication No. 0 057 576, published on Aug. 11, 1982, disclose aqueous coal dispersions wherein nonionic surfactants with at least 100 repeating ethylene oxide units are employed as dispersants.

The present invention has as an object to improve the viscosity and stability of highly concentrated aqueous slurries of pulverized carbonaceous solid fuels. By highly concentrated aqueous slurries are here meant aqueous slurries having a solids content of 65–90% by weight, preferably 70–80% by weight.

To realize this object, there is incorporated in the aqueous slurry surface active additives in concentrations of 0.02–2.0% by weight of the total slurry, a major portion of said surface active additives being comprised of a nonionic agent which is an alkylene oxide adduct having a hydrophobic part and a hydrophilic part, the hydrophilic part containing at least one polyalkylene oxide chain having a length of 40–200, preferably 50–150 alkylene oxide units and a minor portion of said surface active additives being comprised of an ionic agent.

The nonionic agent is preferably a compound having the formula $$RO(CH_2CH_2O)_nH$$

wherein R denotes an aliphatic or acyl group comprising 10–24 carbon atoms or a substituted aryl group comprising 12–54 carbon atoms; and n is at least 40 but less than 100, or n is 40–200 in which latter case the ratio of ethyleneoxy units to the number of carbon atoms in the group R is 3.5–6.0 when R is an aliphatic or acyl group and 3.0–5.5 when R is a substituted aryl group.

By the term "surface active" is here meant that a 0.1% solution of the alkylene oxide adduct in water having a temperature of 20° C. has a surface tension below 50 dynes/cm, measured according to the Du Noüy ring method. Alkylene oxide adducts having a surface tension of 40–49 dynes/cm are especially suitable.

As explained by the above, the major portion of the surface active agent is nonionic, i.e. it does not contain any charges. In addition to the nonionic agent an ionic agent is present, the hydrophobic part of which by means of electrostatic attraction displays stronger adsorption to the fuel particles. Depending on whether the surface of the carbonaceous fuel displays negative or positive charges, such stronger adsorption by means of electrostatic attraction is realized by making the surface active agent, at its hydrophobic part, cationic or anionic. By including an ionic agent the adsorption of the nonionic surface active agent is enhanced. This allows a reduction of the total required amount of surface active additives as compared to the case in which only nonionic surface active additives are used. The increased efficiency realized by the combination of surface active agents may alternatively be utilized to reduce the water content or improve the stability of the aqueous slurry. The choice of ionic agent and the relative amounts thereof to be used is made according to the surface properties of the solid fuel particles. If the surfaces display predominantly negative charges a cationic surface active agent is chosen and in the opposite case an anionic surface active agent is chosen. The amount of ionic surface active agent used relative to the amount of nonionic surface active agent is dependent on the extent of particle surface charge. Usually the ionic agent is added in an amount of 0.1 to 33, preferably 0.5 to 25 and more preferably 2–8% of the total amount of surface active additives.

The combination of such a nonionic surface active agent and an ionic surface active agent makes it possible to achieve a steric stabilization of the highly concentrated fuel slurry in that the hydrophobic part of the nonionic surface active agent is adsorbed to the surfaces of the fuel particles, while the hydrophilic part, the polyalkylene oxide chain, of the alkylene oxide adduct binds a water layer to the surface of the fuel particle. If the surface of each particle is covered by adsorbed alkylene oxide adduct, each fuel particle in the aqueous slurry will be surrounded by such a bound water layer or casing. This water layer around each fuel particle reduces the internal friction in the aqueous slurry so that the particles can execute a sliding movement past one another which remains unaffected by the attractive forces between the particles. The presence of minor amounts of an ionic surface active agent enhances the adsorption of the nonionic surface active agent, thereby further enhancing the steric stability.

The characteristic features of the invention will appear from the claims.

According to one aspect of the invention, there is thus produced an aqueous slurry of a solid fuel in the form of a pulverized carbonaceous material and 0.02–2% by weight of surface active additives, the solids content of the slurry being 65–90% by weight, and the aqueous slurry being characterized in that said additives comprise, as a major part, (1) a water-soluble, nonionic surface active agent which is an alkylene oxide adduct having a hydrophobic part and a hydrophilic part, said hydrophilic part having at least one polyalkylene oxide chain with a length of 40–200 alkylene oxide units and as a minor part, (2) an ionic surface active agent.

According to another aspect of this invention, there is provided a process of producing an aqueous slurry of a solid fuel in the form of a pulverized, carbonaceous material and 0.02–2% by weight of surface active additives, the solids content of the slurry being 65–90% by weight, and the process being characterized by the following steps:

(a) wet-milling a carbonaceous starting material together with water at a solids content of 20–50% by weight in at least one milling step;

(b) separating, if necessary, inorganic material of the carbonaceous starting material from the carbonaceous material of said starting material;

(c) dewatering the carbonaceous material to a solids content which is substantially equal to the solids content of the final slurry;

(d) adding to and distributing in the dewatered carbonaceous material said additives comprising, as a major constituent, (1) a water-soluble nonionic surface active agent which is an alkylene oxide adduct having a hydrophobic part and a hydrophilic part, said hydrophilic part having at least one polyalkylene oxide chain with a length of 40–200 alkylene oxide units and, as a minority constituent, (2) an ionic surface active agent.

According to a further aspect of this invention, there is provided a means for producing an aqueous slurry of a solid fuel in the form of a pulverized carbonaceous material and 0.02–2% by weight of water-soluble surface active additives, the solids content of the slurry being 65–90% by weight, characterized in that said means comprises an ionic surface active agent having the general formula

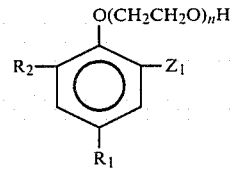

(IX)

wherein $R_1$ and $R_2$ are hydrogen or an alkyl group with 1–22 carbon atoms, provided that the sum of the number of carbon atoms of $R_1$ and $R_2$ is at least 6, and $Z_1$ designates the group $—SO_3H$, $—CH_2{+}NHR_3R_4X^-$ or $—CH_2{+}NR_3R_4R_5X^-$, wherein $R_3$, $R_4$ and $R_5$ are alkyl and/or hydroxyalkyl groups with 1–4 carbon atoms and X is an anion, and n is 40–200.

It must be emphasized that the present invention, as has been mentioned before, relates to concentrated aqueous slurries, i.e. slurries having a solids content of at least 65–90% by weight, preferably 70–80% by weight. This means that the water constitutes but a minor part of the slurry and is present in a content below 35% by weight, preferably 20–30% by weight. The inventors have discovered that many of the properties and alleged advantages obtained by prior art technique concern relatively low-concentrated slurries having a water content of at least about 40% by weight, and that it is not possible to increase the solids content to above 65% by weight and, at the same time, retain sufficient pump-ability and stability of the slurry.

However, it has now been surprisingly found that these problems can be eliminated by adding a combination of a nonionic water-soluble surface active agent which is an alkylene oxide adduct having a hydrophobic part and a hydrophilic part, the hydrophilic part having at least one polyalkylene oxide chain with a length of at least 40 alkylene oxide units, i.e., the hydrophilic part has at least one hydrophilic chain having a given minimum length; and an ionic surface active agent. It has been found that this minimum length of the hydrophilic chain is an indispensable condition for achieving a stable and low-viscous, i.e. pumpable fuel slurry at a solids content exceeding 65% by weight. Actually, there is no upper limit for the length of the hydrophilic chain, but for practical and economic reasons it is preferred, in the context of this invention, to limit the chain length to 200 alkylene oxide units at the most. The best results of the present invention have been obtained with alkylene oxide adducts containing 50–150 alkylene oxide units in the hydrophilic chain. Furthermore, it is especially preferred that the alkylene oxide units in the hydrophilic chain consist of ethylene oxide units.

The stability of the slurry, i.e. its resistance to separation of the water from the solids during storage and transport of the slurry, including vibration of the slurry and the rheological properties of the slurry reach an optimum within the preferred range of alkylene oxide units of the hydrophilic chain. Thus, if the hydrophilic chain is too short (the number of alkylene oxide units is below 40), separation and sedimentation will occur if the slurry has been subjected to vibration for a few days. It has also been found that the rheology of the slurry deteriorates as the length of the hydrophilic chain is increased beyond 200 or even 150 alkyleneoxy units.

In addition to the hydrophilic part as described above, the nonionic surface active agent according to the invention also comprises a hydrophobic part, which is adapted to adsorption onto the surface of the pulverized carbonaceous material.

The nonionic surface active agent can be obtained by adding alkylene oxide having 2–4 carbon atoms in such a manner to an organic compound made up of hydrogen and carbon and, optionally, oxygen, or sulphur, and having 1–20 hydrogens reactive with ethylene oxide, propylene oxide or butylene oxide, that a nonionic surface active agent with an alkylene oxide chain having at least 40 alkylene oxide units is obtained. Compounds of this type may be expressed by the general formula $$R[Y(A)_nH]_m \quad (I)$$

in which R is a residue of the organic compound, Y is oxygen or sulphur, A is an alkylene oxide group having 2–4 carbon atoms, n is an integer of 40–200, preferably 50–150, and m is an integer of 1–20, wherein at least 40 repeating alkylene oxide units e.g. ethylene oxide units form a chain.

If R has been derived from a low-molecular compound or from a compound of insufficient hydrophobic character, it will be necessary to add propylene oxide and/or butylene oxide to form a block, thereby to obtain a sufficiently large hydrophobic residue in order to impart sufficient surface activity to the final compound.

Another possibility is to modify compound I by introducing a hydrophobic group, in which case it should be observed, however, that the new final compound must contain at least one polyalkylene glycol chain made up of at least 40 ethylene oxide groups.

The organic compound to which alkylene oxide is added may be a mono- or polyfunctional hydroxyl and/or carboxyl compound containing 1–40 carbon atoms, or an oligomeric or polymeric compound having several hydroxyl and/or carboxyl groups. Examples of suitable monofunctional hydroxyl and carboxyl compounds are methanol, ethanol, propanol, butanol, hexanol, cyclohexanol, acetic acid, propionic acid, butanoic acid, hexanoic acid and 2-ethyl hexanoic acid. Examples of polyfunctional hydroxyl and carboxyl compounds are glycerol, trimethylolpropane, butylene glycol, butane triol, hexane triol, pentaerythritol, sorbitol, sorbitan, saccharides, such as saccharose, glucose, arabinose, fructose, mannose, dextrose, lactose and maltose, succinic acid, glutaric acid, adipic acid, sebacic acid, phthalic acid, isophthalic acid, dodecane dicarboxylic acid and resorcinol.

Especially preferred nonionic alkylene oxide adducts based upon polyfunctional compounds are the so-called block copolymers which are made up of blocks consisting of ethylene oxide, propylene oxide and, optionally, butylene oxide. The molar weight of the propylene oxide or, alternatively, the butylene oxide moiety or moieties should preferably lie within the range 1500–4000, while the polyethylene oxide moiety or moieties should preferably have a molar weight of 2000–10000.

Other examples of compounds comprised by formula I are alkoxylated sulphur compounds having the general formula $$R^3—S—(A)_nH \quad (II)$$

in which $R^3$ represents a hydrocarbon group having 1–24 carbon atoms or, preferably, the group $(A)_nH$, each A represents an alkylene oxide group having 2–4 carbon atoms, and n = at least 40, preferably 50–200.

In the event that the organic compound is a carboxylic acid having 10–24 carbon atoms or an aromatic hydroxyl compound having 12–54 carbon atoms, the hydrophobic groups are sufficiently large to impart to the compound a sufficient surface activity, for which reason an increase of the hydrophobic part by adding propylene oxide and/or butylene oxide is not necessary. These compounds may be illustrated by the general formula $$RO(CH_2CH_2O)_nH \quad (III)$$

in which R represents an aliphatic acyl group having 10–24, preferably 14–24 carbon atoms or a substituted aryl group having in total 12–54, preferably 14–42 carbon atoms, and n is 40–200. Especially preferred are such compounds in which n is at least 40 but less than 100, or in which n is 40–200 in which latter case the ratio of ethyleneoxy units to the number of carbon atoms in the group R is 3.5–6.0 when R is an aliphatic or acyl group and 3.0–5.5 when R is a substituted aryl group.

Examples of suitable organic compounds having active hydroxyl groups are decyl alcohol, lauryl alcohol, myristyl alcohol, cetyl alcohol, stearyl alcohol, eicosyl alcohol, oleyl alcohol, cyclododecanol, cyclohexane decanol, octyl phenol, nonyl phenol, dodecyl phenol, hexadecyl phenol, dibutyl phenol, dioctylphenol, dinonyl phenol, didodecyl phenol, dihexadecyl phenol, trinonyl phenol, capric acid, lauric acid, myristic acid, palmitic acid, stearic acid, oleic acid, linoleic acid and arachidic acid.

To further illustrate the special surface active compound according to the invention, the following examples of useful compounds are given.

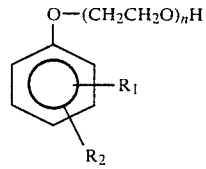

-continued

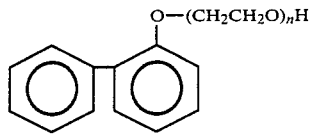

wherein $R_1$ designates an alkyl group, $R_2$ designates an alkyl group or hydrogen and n is either at least 40 but less than 100, suitably at least 50 but less than 100, and preferably 50–90, or n is 40–200, preferably 50–150, in which latter case the ratio of ethyleneoxy units to the number of carbon atoms in the substituted phenyl group is 3.0–5.5. Disubstituted compound are particularly preferred and especially those in which $R_1$ and $R_2$ are nonyl groups.

Further examples of alkylene oxide adducts that may be used with the present invention are polyalkylphenol polymethylene or polyalkylnaphthalene polymethylene compounds in which some or all OH are alkoxylated with 40–200 alkylene oxide groups, preferably ethylene oxide groups. When all OH have been alkoxylated, the polyalkylphenol polymethylene compounds show the general formla IV:

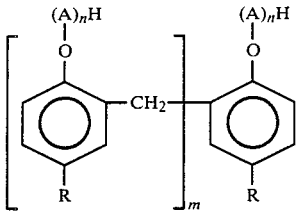

(IV)

in which

R=an alkyl group having 1–20 carbon atoms n=40–200 m=1–20

The ionic surface active agent may, in principle, be freely selected from known ionic surface active compounds. Some of the most appropriate types of anionic compounds generally available are those of the following formulae:

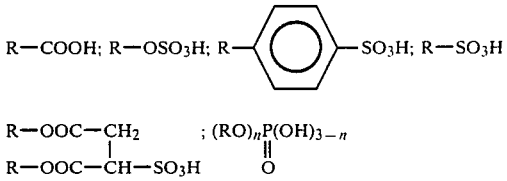

wherein R denotes a hydrophobic group with 8–22 carbon atoms and n is the integer 1 or 2; or a salt thereof with an alkali metal, an alkaline earth metal, an ammonium or an organic ammonium compound. Among the anionic surfactants especially alkylarylsulphonates of the following formula may be mentioned:

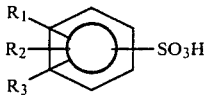

wherein $R_1$, $R_2$ and $R_3$ independently of each other denote an alkyl group with 1–18 carbon atoms or hydrogen, with the proviso that the total number of carbon atoms in the alkyl groups is 6–22; or a salt thereof with an alkali metal, an alkaline earth metal, an ammonium or an amine compound.

Other suitable anionic surface active agents are aliphatic, e.g. alkyl, sulphates and phosphates which may be illustrated by the general formulae $$R—OSO_3H$$

and $$(RO)_nP(OH)_{3-n}$$

wherein R is a straight or branched, saturated or unsaturated aliphatic group with 10–22 carbon atoms and n is the integer 1 or 2; or a salt thereof with an alkali metal, an alkaline earth metal, an ammonium or an amine compound. As specific examples of alkyl sulphates lauryl sulphate, myristyl sulphate, stearyl sulphate and oleyl sulphate may be mentioned.

Suitable cationic surface active agents are those which display at least one long hydrophobic chain attached to the tertiary or quaternary nitrogen group. They must be soluble or dispersible in water.

Examples of such cationic surface active agents are quaternary ammonium compounds containing one or two hydrophobic groups with 8–22 carbon atoms according to the general formula:

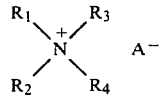

wherein $R_1$ denotes a straight or branched, saturated or unsaturated aliphatic group containing 8–22 carbon atoms or a unsubstituted or substituted phenyl alkyl group containing a total of 7–22 carbon atoms in the phenyl alkyl group, or an alkyl-cycloalkyl group containing a total of 8–22 carbon atoms, $R_3$ and $R_4$ denote independently of each other a methyl, an ethyl or a hydroxyethyl group and $R_2$ denotes an $R_1$ or $R_3$ group. A is an anion.

Other suitable cationic agents are tertiary ammonium compounds of the general formula:

$$R_1R_2N(R_3)$$

wherein $R_1$, $R_3$ and $R_2$ have the same meaning as in the above formula regarding quaternary ammonium compounds.

Particularly suitable ionic surface active agents are those which contain an ionic group at the hydrophobic moiety of the compound, i.e. immediately adjacent to, or incorporated in, the hydrophobic part of the compound, and a free attached nonionic alkylene oxide chain. Such ionic compounds assist in enhancing the steric stability since they contain a water soluble ethylene oxide chain.

Examples of other particularly suitable ionic surface active agents are described by the formula:

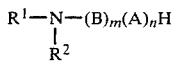

wherein $R^1$ and $R^2$ independently of each other denote an aliphatic group containing 1–24 carbon atoms, and wherein the group:

$$(B)_m(A)_nH$$

B denotes an oxyalkylene group with 3 to 4 carbon atoms, A denotes an oxyethylene group, m is a number 0 to 50 and n is an integer 2–150, preferably 5–100, most preferred 10–90; or a quaternary compound thereof. The groups $R^1$, $R^2$ and $(B)_m(A)_nH$ are adjusted to each other so that a surface active agent is obtained.

Other compounds of a closely related type are those represented by the following formula:

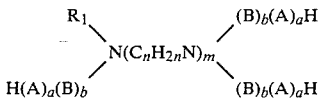

wherein $R_1$ is an aliphatic group having 8–24 carbon atoms or the group $H(A)_a(B)_b$, A is an oxyethylene group, B is an oxyalkylene group containing 3–4 carbon atoms, a is at least 40, preferably 50–150, b is a number from 10 to 25, n is a number from 2 to 6 and m is a number from 1 to 3. Examples of such compounds are reaction products from alkylenediamines, dialkylenetriamines or trialkylenetetramines to which propylene oxide and/or butylene oxide and ethylene oxide are added so as to reach a molecular weight of about 14000 to 20000 and an ethylene oxide content of about 70 to 80% by weight.

Further suitable compounds are those of the general formula:

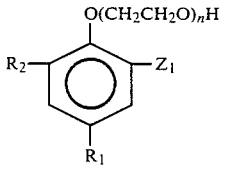

(IX)

wherein $R_1$ and $R_2$ are hydrogen or an alkyl group with 1–22 carbon atoms, provided that the sum of the number of carbon atoms of $R_1$ and $R_2$ is at least 6, and $Z_1$ designates the group $—SO_3H$, $—CH_2{+}NHR_3R_4X^-$ or $—CH_2{+}NR_3R_4R_5X^-$, wherein $R_3$, $R_4$ and $R_5$ are alkyl and/or hydroxyalkyl groups with 1–4 carbon atoms and X is an anion, and n is 40–200, preferably 50–150 and most preferred 60–90; or a salt thereof.

In these last-mentioned compounds $R_1$ and $R_2$ usually are hydrogen or a butyl, octyl, nonyl or dodecyl group. These compounds exhibit, in combination with nonionic surface active ethylene oxide adducts, very favorable properties and it is possible to produce an aqueous solid fuel slurry with this combination which displays a very high solids concentration, satisfactory stability and low viscosity.

The compounds of formula IX may be produced by methods known per se by those skilled in the art.

When the ionic constituent is a cationic compound the most preferred combination is one which contains a tertiary or quarternary nitrogen compound.

The concentration of the surface active agents in the aqueous slurry according to the invention, amounts in total to 0.02–2% by weight, based upon the aqueous slurry. Preferably, the concentration of the surface active compounds according to the invention is 0.05–0.8% by weight of the slurry.

In addition to the above-mentioned specific surface active compounds according to the invention, the slurry may also incorporate other conventional additives, such as antimicrobial agents, antifoaming agents, pH-modifying additives, and conventional stabilizers increasing the effect of the surface active compounds according to the invention or producing a further effect.

The addition of conventional stabilizers is especially suitable when the hydrophilic part of the dispersant is relatively short. Examples of conventional stabilizers are protective colloids, such as xanthan gum, cellulose derivatives, such as carboxy methyl cellulose, ethylhydroxyethyl cellulose, hydroxyethyl cellulose, clays, such as attapulgite, sepiolite, bentonite, aluminum hydroxide, silica gel, cellulose suspensions, carbon black, starch and starch derivatives.

If further additives are to be used, over and above the specific surface active compounds, the rule is that the conventional stabilizer should be added up to a concentration of at most 1% by weight, preferably at most 0.2% by weight, while the antifoaming agent should be added up to a concentration of at most 0.1% by weight, all based upon the weight of the slurry. The pH-modifying additive which, preferably, is an alkali metal hydroxide, such as sodium hydroxide, is added in such an amount that the pH of the slurry is caused to lie on the alkaline side, for example above pH 10, thereby to eliminate corrosion problems in transport and storage equipment.

Furthermore, the aqueous slurry according to the invention contains as the major component a solid fuel in the form of a pulverized, carbonaceous material. As has previously been mentioned, the carbonaceous material is selected among bituminous coal, anthracitic coal, sub-bituminous coal, lignitic coal, charcoal and petroleum coke. If one disregards the solids content that is conditioned by the additives, the content of the slurry of pulverized, carbonaceous material may be equated with the solids content of the slurry, i.e. it is 65–90% by weight, preferably 70–80% by weight, based upon the total weight of the slurry. The pulverized carbonaceous material need not be subjected to any treatment to increase its hydrophobicity.

The particle size of the pulverized carbonaceous material plays an important part regarding the stability of the slurry according to this invention. To arrive at an optimal particle size several considerations are required. First of all, impure, solid fuels, such as coal, must be concentrated to eliminate inorganic impurities from the organic material. The particle size must be adapted so that it will permit satisfactory release of the impurities. In the second place, fuel slurries should preferably have a particle size not exceeding 100–250 μm to ensure complete combustion of the fuel particles in the flame. It is also desirable to keep down that fraction of the particles which is greater than 100 μm, thereby to minimize wear of the burner and similar equipment for handling the slurry. In the third place, the particle size distribution must, of course, be such that it entails, to the greatest possible extent, a minimum water content, minimum viscosity and maximum stability of the slurry.

Owing to the favourable properties of the specific surface active compound according to the present invention, the last-mentioned requirement concerning the particle size distribution is not as critical as is normally the case in highly concentrated aqueous slurries of solid fuels, and the invention admits of certain fluctuations in the particle size distribution, as is normally the case under commercial production conditions, without detriment to the viscosity or stability of the slurry. More particularly, it has been found that for the present invention the particle size should lie within the range 0.1–350 μm, preferably 1–250 μm. For maximum results, however, the particle size should not exceed about 200 μm.

For some applications, such as the burning of the fuel slurry in a fluidized bed or the injection of the fuel slurry into blast furnaces, the particle size of the pulverized, carbonaceous material is not especially critical, and the fuel slurry may include relatively large particles, without causing any difficulties. However, one should not go beyond a particle size of about 0.5 mm because of the risk of particle sedimentation which may occur if the particles are too large.

The invention has been described above with reference to that aspect thereof which concerns an aqueous slurry of a solid fuel.

The process for producing an aqueous slurry according to the present invention will now be described in connection with a solid fuel in the form of bituminous coal. The basic technology is the same for other solid fuels, such as sub-bituminous, anthracitic and lignitic coal, charcoal and petroleum coke and other solid refinery by-products etc., or combinations thereof, even though these fuel types are not in every respect processed in the same manner. Thus, certain solid fuels do not require the purification step which is described and applied to the coal referred to below, whereas some fuels having high affinity to water (charcoal, lignite etc.) require a surface treatment to increase the hydrophobic characteristics, and in some cases the differences in the mechanical properties of different types of coal necessitate milling equipment which is different from the equipment described below for bituminous coal.

A suitable starting material is bituminous coal that has been crushed to a certain extent and subjected to primary concentration in conventional manner, such that the content of inorganic matter in the coal, exclusive of moisture, has been reduced to about 5–20% by weight. The resulting product is then reduced in conventional manner to a particle size suitable for a first milling step which preferably is a wet-milling operation in a ball or rod mill.

By this first milling step three objects are realized:

1. Milling to a maximum particle size providing for a sufficient release of inorganic impurities in the coal.
2. Milling to a maximum particle size suitable for the contemplated use, i.e. a size which can burn out completely in the reaction zone, for instance a flame.
3. Milling to a particle size distribution suitable for the rheological characteristics of the fuel.

The conditions that must be fulfilled to attain the objects 1 and 2 are laid down on one hand by the mineralogy of the coal and, on the other hand, by the method of application. As has been mentioned before, a particle size of about 0.5 mm should not be exceeded, and normally it does not exceed 350 μm. Usually, it is preferred that the maximum particle size be about 100–200 μm.

Regarding the particle size distribution, it is a well-known fact that the size distribution of a particle aggregation can be optimized in order to minimize the pore number of the particle aggregation, i.e. the volume not taken up by solid matter. The present invention makes no absolute demand for any specific distribution in order to obtain a composition having a low water content, low viscosity and satisfactory stability. Investigations of a number of coal types show that, depending both on the type of the coal and on the milling method, different compositions of particle shapes can be identified in the particle aggregation after the milling operation. This means that there exists for every coal type and for every milling operation, i.e. the milling circuit and the mill types included therein, a given size distribution which gives an optimal water content and viscosity and which can be established by the expert.

What is more, the particle geometries of the composition may affect the rheology and stability. Thus, it is possible to select certain mill types for the mill circuit in order to give a dominant position to, for example, equiaxial grains or discoid and flake-like grains, thereby to influence the final properties of the composition in a manner favourable to each specific application.

It is, however, an important aspect of this invention that the stabilizing and viscosity-reducing chemical additives to produce useful fuels with low water content are not critically dependent upon specific size distributions. On the other hand, it is propitious to produce, according to known principles, such size distributions as give a maximum content of solid matter in the composition, and further advantages are obtainable by controlling the particle shapes.

The tendency of different mill types to give different particle geometries may be exemplified as follows:

| | |
|---|---|
| Hammer mill: | Dominance of equiaxial particles on milling of bituminous coal. |
| Wet milling in rod mill: | Dominance of irregular pointed and needle-shaped particles upon milling of bituminous coal. |
| Szego mill: (from General Comminution, Inc. Toronto, Canada) | Flat flake-shaped particles upon milling of bituminous coal. |

Some examples of suitable size distributions are the following:

1. Bituminous coal from United Coal Companies, Virginia USA (Widow Kennedy Seam)

| | | |
|---|---|---|
| Composition: | Fixed carbon: | 65% |
| | Volatile components | 28% |
| | Mineral components | 7% |

The following particle size distribution has resulted in finished compositions containing a solid fraction of up to 83.5% (total fraction of solid matter, % by weight of dry matter):

| | | |
|---|---|---|
| Less than | 200 μm | 100% |
| Less than | 150 μm | 91% |
| Less than | 100 μm | 78% |
| Less than | 75 μm | 71% |
| Less than | 45 μm | 58.5% |

-continued

| | | |
|---|---|---|
| Less than | 25 μm | 47% |

2. Bituminous coal from Cape Breton Development Co., Nova Scotia, Canada (Harbour Seam)

| | | |
|---|---|---|
| Composition: | Fixed Carbon: | 63.5% |
| | Volatile components | 34.0% |
| | Mineral components | 2.5% |

The following particle size distribution has resulted in finished compositions containing a solids fraction of up to 78% (% by weight of dry matter):

| | | |
|---|---|---|
| Less than | 200 μm | 100% |
| Less than | 150 μm | 91% |
| Less than | 100 μm | 78% |
| Less than | 75 μm | 71% |
| Less than | 45 μm | 58.5% |
| Less than | 25 μm | 47% |

In the most typical cse, the first milling step uses wet milling in a ball mill and/or rod mill. This does not preclude the use of other conventional mill types which are known to the expert and can be selected depending upon the characteristic milling properties of each coal type. The mill circuit which comprises one or several mills and classification equipment, is designed in such a manner that the conditions 1–3 as previously mentioned are fulfilled. In order to attain a suitable size distribution the milling circuit must be designed in a special manner since it is only in exceptional cases that the passage through one mill or several mills of the same type results in a suitable distribution. In most cases, the best results are obtained with a mill circuit based upon a division into different fractions, whereby the natural tendency of the coal to give a specific size distribution can be counteracted.

One of the difficulties encountered in these milling operations resides in that their particle size distribution gives a concentration of particles in the intermediate range so that the distribution will be too narrow, which means that the volume concentration of solid matter will be insufficient. This can be remedied by designing the mill circuit for instance in the following manner.

Coal is introduced, together with water, into a ball mill for wet milling. The milling product which is coarser than the final product from the first milling step, is conducted to a sieve which allows material whose particle size is below the desired maximum size to pass. Coarse material which does not pass through the sieve, is conducted to a second ball mill where size reduction is effected to increase the fine fraction of the final milling product. A hydrocyclone disposed after the ball mill separates the milling product from the ball mill into a fine and a coarse fraction, and the coarser material is recycled to the ball mill. The fine fraction is recycled to the sieve, whereby the final milling product is obtained which has a maximum size determined by the sieve and which contains both coarser and finer particles within the desired range.

The above example is far from being the only conceivable solution of a milling circuit for the first milling step and merely is intended to show how a suitable milling product can be obtained by using conventional milling technology. A person skilled in the art and familiar with the above-described principles which are valid for particle sizes and particle size distributions, as well as the properties of the type of coal at his disposal, is capable of testing and constructing operational mill circuits based upon known mill types.

The milling product from the first milling step, which is suspended in an aqueous phase, may then if necessary be conducted to a separation process where inorganic components are separated from substantially organic solid fuel components. The separation process conventionally consists of froth flotation in one or more steps, implying either (i) that organic components are raised by utilizing their natural flotability or, should this be insufficient, by means of a flotation reagent, such as kerosene or fuel oil which enhance the flotability. At the same time, pyrite can be passivated by adding for example $FeCl_3$, calcium ions or other additives reducing the affinity of the pyrite to air bubbles. A purification carried out in this manner has been found to give, depending upon the type of coal, ash contents of 1–5% in coal concentrates; or (ii) that the flotation is conducted inversely such that the coal is passivated and inorganic components are floated off by means of hydrophobating additives which selectively render inorganic additives hydrophobic.

Flotation may also be carried out in part steps between intermediate milling steps for intermediate products to release further inorganic substance and increase the purity of the final concentrate.

Besides flotation, the purification process may also include other physical separation processes, such as high-intensity magnetic separation and other known purification processes that can be used for fine particles in the wet phase.

Flotation may result in certain changes in the particle size distribution, as compared with the milling product from the first milling step. A second milling step for a given part flow of concentrate particles must therefore be carried out in certain cases, primarily in order to compensate for the loss of the finest particles of the particle aggregation.

The choice of the mill type will depend upon the necessity of milling a given part quantity of material, usually 5–25% of the total quantity, to a given maximum particle size, and presents no difficulties to the expert who knows the desired final particle size distribution.

The concentrate from the first milling step, or from the second milling step, if any, has a solids content of about 20–50% by weight, usually about 25% by weight. The concentrate must therefore be dewatered to a water content which preferably is one or two percentage units lower than the water content of the final composition since the additives used are preferably added in the form of aqueous solutions.

Dewatering is normally conducted in two steps, i.e. thickening followed by filtering in either a vacuum filter or a filter press. In some instances, a flocculant may be present in the thickener, provided that it does not interact with the additives for the composition according to the invention.

When extremely low water contents are desired, for instance below 20% by weight, dewatering may be completed by admixing a dry, milled and sufficiently pure coal product.

After dewatering, there is added to the resulting filter cake one or more additives including at least the surface active compound according to the invention. As has been mentioned above, the additive is supplied in the form of an aqueous solution admixed to the filter cake. The mixing process and equipment are designed in such a manner that the mixture will be as homogeneous as possible, and such that the particle surfaces are covered as completely as possible by the additive.

After dewatering has been effected and the additive has been supplied, the composition is pumpable and is pumped to storage tanks for further transport to the user.

The use of the fuel slurry according to this invention should be obvious, but in addition to the self-explanatory transport and handling applications (the fuel slurry is pumpable, for instance for transport in pipelines), special mention is made of the following uses.

The fuel slurry can be burned directly in industrial burners, heating plants or combined power and heating plants for the production of steam and hot water. The fuel slurry according to the invention is capable of replacing the conventional fuels presently used, such as oil or coal powder, whereby a better fuel economy as well as considerable advantages in respect of handling and transport are obtained.

Combustion and gasification of the fuel slurry according to the invention can occur in plants operating under pressure, resulting in a better fuel economy when the fuel slurry is used instead of oil, and in a greater ease of handling when the fuel slurry is used instead of conventional solid fuels. Gasification in pressurized reactors of the Texaco type, combustion in pressurized fluidized beds, and injection of the fuel slurry at the tuyere level of blast furnaces may be mentioned as examples.

Of special importance to the usefulness of the fuel slurry according to the invention are the following characteristics.

The fuel slurry can be atomized, i.e. dispersing the fuel in burner nozzles or the like results in a minimum number of aggregations of individual particles. Such aggregation is counteracted above all by the special dispersant according to the invention.

The fuel slurry is pumpable also at increased shear rates upon injection through various types of spreaders and at high pressures when the slurry is injected against pressurized reactors.

The fuel slurry has a low water content, which is of great importance to combustion processes and especially important in the gasification in connection with the production of synthesis gas where far higher yields are obtained in that the water content of the fuel can be kept considerably below 30% by weight.

As a result of the purification step in the production process, the fuel slurry has but a low content of inorganic impurities, such as sulphur compounds and other mineral components.

To further illustrate the invention and its advantages the following Examples are given which, however, are not intended to restrict the invention. The pulverized carbonaceous material used in Examples 1 and 2 consisted of bituminous coal from the eastern USA, more particularly from United Coal Companies, Virginia, USA (Widow Kennedy Seam). The composition of this coal has been specified before. After wet milling in a rod mill and ball mill, particles were obtained which had a particle distribution that has also been mentioned before. The specific surface area of the coal powder was 4.5 $m^2/g$, determined according to the BET method by nitrogen adsorption.

EXAMPLE 1

A slurry was prepared from 68.0 parts by weight of coal powder 0.35 parts by weight of a 75/25 mixture of surfactants comprising ethoxylated (100 EO) dinonylphenol and quaternary, ethoxylated coconut oil amine 31.65 parts by weight of water For the production of the slurry, the dry coal powder was mixed with the water, whereupon the aqueous solution of the 75/25 mixture of nonionic and ionic surfactant was added to provide a slurry having a total solids content of 68%.

Rheological data for the slurry were determined by means of a Contraves Reomat 115 viscosimeter. The result obtained during 2.21 minutes of acceleration from 0 to 450 $s^{-1}$, 5.0 minutes at 450 $s^{-1}$ and deceleration during 2.21 minutes is shown in Table 1.

TABLE 1

| Shear rate ($s^{-1}$) | Apparent viscosity (cP) | |
|---|---|---|
| | Accelerated | Decelerated |
| 32.6 | 117 | 55 |
| 100 | 118 | 63 |
| 200 | 119 | 68 |
| 300 | 120 | 72 |
| 450 | 112 | 75 |

EXAMPLE 2

A slurry was prepared from:

81.0 parts by weight of coal 0.77 parts by weight of the 75/25 mixture of surfactants according to Example 1

18.23 parts by weight of water

To prepare the slurry, one proceeded in the same manner as in Example 1. The rheological characteristics will appear from Table 2.

TABLE 2

| Shear rate ($s^{-1}$) | Apparent viscosity (cP) | |
|---|---|---|
| | Accelerated | Decelerated |
| 32.6 | 1240 | 810 |
| 100 | 1200 | 780 |
| 200 | 1280 | 800 |
| 300 | 1410 | 900 |
| 450 | 1600 | 1090 |

Slurries prepared in accordance with Example 1 and Example 2, above, were tested in actual practice by static and vibratory storage and transport by ship for a period of 4 weeks. No separation of the water from the solids could be observed.

EXAMPLES 3-8

A coal water slurry with a coal content of 72% by weight was prepared by incorporating 0.5% by weight of the slurry of a dinonylphenol polyethylene glycol ether having 80 oxyethylene units and an ionic compound in a molar ratio between the ionic compound and dinonylphenol polyethylene glycol ether of 0.01. The ionic compound used was as stated in the Table below.

The coal used was an East Canadian high volatile bituminous coal from Cape Breton and had the particle size distribution disclosed on page 28. The slurry was thoroughly mixed and was then kept at 20° C. at 24 hours, after which the viscosity was measured in a Contraves Rheomat 115 concentric cylinder viscosimeter using measuring system 125 (DIN standard) by accelerating the samples from 0 to 1008 $s^{-1}$ during 5 minutes. The viscosity was calculated at 492 and 1008 $s^{-1}$.

The following results were obtained:

| EXAMPLE | IONIC COMPOUND | VISCOSITY 492 $s^{-1}$ | VISCOSITY 1008 $s^{-1}$ |
|---|---|---|---|
| 3. | 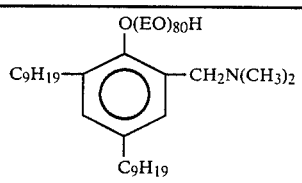 | 0.350 | 0.290 |
| 4. | 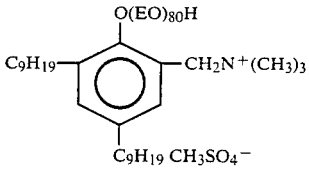 | 0.331 | 0.283 |
| 5. | $Alkyl_{COCO}—N^+—[(EO)_7H]_2$ (CH3, $CH_3SO_4^-$) | 0.316 | 0.274 |
| 6. | Cetyl-$N^+—(CH_3)_3$ | 0.320 | 0.280 |
| 7. | Triethanolamine + 45PO + 180EO | 0.406 | 0.326 |
| 8. | $Alkyl_{tallow}$-$NHCH_2CH_2NH_2$ + 100PO + 93EO | 0.416 | 0.337 |
| Comparison | none | 0.418 | 0.342 |

EXAMPLE 9

In the same manner as in Example 3, a coal water slurry was prepared but instead of the dinonylphenol polyethylene glycol ether a nonionic compound obtained from $$CH_3CH_2C(CH_2OH)_3+45PO+120EO$$

was used in an amount of 1.12% by weight of the slurry. The viscosity of the slurry was 0.580 Pa·s and 0.413 at a shear rate of 492 $s^{-1}$ and 1008 $s^{-1}$, respectively. The corresponding values without the presence of an ionic compound were 0.835 Pa·s and 0.470 Pa·s.

EXAMPLE 10

Two slurries were prepared. One slurry was prepared using ethoxylated(80EO)dinonylphenol (surfactant A) as surfactant and the other slurry was prepared using a blend of the above-mentioned surfactant and an ethoxylated dinonylphenol(80EO)-methyl-dimethylamine (surfactant B) in the proportions 96 weight% surfactant A and 4 weight% surfactant B. The slurries were prepared in the following way:

To a 250 ml beaker containing water and surfactant a pulverized high volatile bituminous coal from Cape Breton Development Co., Sydney, Nova Scotia (Harbour seam) was added. The mixture was stirred with a propeller at a speed of 2100 rpm for 15 minutes. An antifoaming agent was added. The mixture was further stirred with the propeller now at a speed of 250 rmp for another 15 minutes. 24 hours later its rheology was determined in a Contraves Rheomat 115 concentric cylinder viscosimeter using measuring system 125 (DIN standard). The sample was accelerated to a shear rate from 0 to 451.5 $s^{-1}$ and the viscosity was calculated at 100 $s^{-1}$.

The samples had the following composition:

| | |
|---|---|
| Total moisture content | 26.5 weight % |
| Total surfactant content | 0.55 weight % |
| Antifoaming agent | 0.04 weight % |
| Coal content | 72.9 weight % |
| pH of slurry | 2.7 weight % |
| Density of the slurry | 1.19 g/cm$^3$ |
| The viscosity of the samples were: | |
| Viscosity of the slurry containing surfactant A only | 0.73 Pas |
| Viscosity of the slurry containing a mixture of surfactants A and B | 0.63 Pas |

EXAMPLE 11

Slurries were prepared using various amounts of surfactant blends produced by mixing ethyoxylated(-80EO)-dinonylphenol (surfactant A) and ethoxylated(-80EO)dinonylphenol-sulphonate sodium salt (surfactant B) in the proportions 0.00; 0.34 and 0.72 weight%, respectively, of surfactant B in relation to the total amount of surfactant added.

The same type of coal powder as described in Example 10 was used. The slurries had a density of 1.19 g/cm$^3$ and a moisture content of 26.6 weight% and were prepared and assessed according to the procedure described in Example 10.

The results are shown in the Table below:

| Total surfactant concentration Weight % | Viscosity (Pas) at $s^{-1}$ of slurries produced with the various surfactant blends: 0.00% | 0.34% | 0.72% |
|---|---|---|---|
| | Amount of surfactant B based on total amount of surfactant | | |
| 0.45 | 0.93 | 0.81 | 0.76 |
| 0.55 | 0.91 | 0.78 | 0.76 |
| 0.65 | 0.83 | 0.81 | 0.83 |

From the Table it can be seen that the viscosity and the amount of surfactant required to give minimal viscosity decreased with the incorporation of an ionic compound (surfactant B) in the surfactant blend.

What we claim and desire to secure by Letters Patent is:

1. An aqueous slurry of a solid fuel in the form of a pulverized, carbonaceous material and 0.02–2% by weight of surface active additives, the solids content of the slurry being 65–90% by weight, characterized in that said additives comprise, as a major part, (1) a water-soluble, nonionic surface active dispersing agent which is an alkylene oxide adduct having a hydrophobic part and a hydrophilic part, said hydrophilic part having at least one polyalkylene oxide chain with a length of 40–200 alkylene oxide units at least a part of which are ethylene oxide units and, as a minor part, (2) an ionic surface active agent in which the ionic charges of the ionic surface active agent are located at the hydrophobic moiety thereof.

2. A slurry as claimed in claim 1, characterized in that the ionic surface active agent has a hydrophobic moiety and a hydrophilic moiety and in that the ionic charges of the ionic surface active agent are located at the hydrophobic moiety thereof.

3. A slurry as claimed in claim 1, characterized in that the ionic surface active agent has the general formula

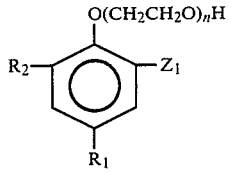

wherein $R_1$ and $R_2$ are hydrogen or an alkyl group with 1–22 carbon atoms, provided that the sum of the number of carbon atoms of $R_1$ and $R_2$ is at least 6, and $Z_1$ designates the group $—SO_3H$, $—CH_2{+}NHR_3R_4X^-$ or $—CH_2{+}NR_3R_4R_5X^-$, wherein $R_3$, $R_4$ and $R_5$ are alkyl and/or hydroxyalkyl groups with 1–4 carbon atoms and X is an anion, and n is 40–200.

4. A slurry as claimed in claim 1, characterized in that the nonionic surface active agent has the general formula $$RO(CH_2CH_2O)_nH$$

wherein R denotes an aliphatic or acyl group comprising 10–24 carbon atoms or a substituted aryl group comprising 12–54 carbon atoms; and n is at least 40 but less than 100.

5. A slurry as claimed in claim 4, characterized in that n is at least 50.

6. A slurry as claimed in claim 1, characterized in that the surface active additives are incorporated in the slurry in an amount of 0.05–0.8% by weight of the slurry.

7. A process for producing an aqueous slurry of a solid fuel in the form of a pulverized, carbonaceous material and 0.02–2% by weight of surface active additives, the solids content of the slurry being 65–90% by weight, characterized by the following steps (a) wet milling a carbonaceous starting material together with water at a solids content of 20–50% by weight in at least one milling step;

(b) separating, if necessary, inorganic material of the carbonaceous starting material from the carbonaceous material of said starting material;

(c) dewatering the carbonaceous material to a solids content which is substantially equal to the solids content of the final slurry;

(d) adding to and distributing in the dewatered carbonaceous material said 0.02 to 2% by weight of surface activity additives comprising, as a majority constituent, (1) a water-soluble, nonionic surface active dispersing agent which is an alkylene oxide adduct having a hydrophobic part and a hydrophilic part, said hydrophilic part having at least one polyalkylene oxide chain with a length of 40–200 alkylene oxide units at least a part of which are ethylene oxide units and, as a minority constituent, (2) an ionic surface active agent in which the ionic charges of the ionic surface active agent are located at the hydrophobic moiety thereof.

8. A process as claimed in claim 7, characterized in that the surface active additives are added in step (d) in an amount of 0.05–0.8% by weight of the slurry.

9. A process as claimed in claim 7, characterized by adding to the dewatered carbonaceous material, in addition to the alkylene oxide adduct, further additives selected among stabilizers, antifoaming agents, pH-modifying additives and antimicrobial agents.

10. An ionic surface-active agent, useful for producing an aqueous slurry of a solid fuel in the form of a pulverized carbonaceous material and 0.02–2% by weight of surface active additives, the solids content of the slurry being 65–90% by weight, having the formula

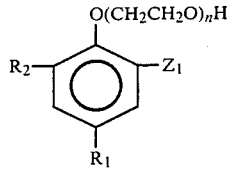

(IX)

wherein $R_1$ and $R_2$ are hydrogen or an alkyl group with 1–22 carbon atoms, provided that the sum of the number of carbon atoms of $R_1$ and $R_2$ is at least 6, and $Z_1$ designates the group $—SO_3H$, $—CH_2{+}NHR_3R_4X^-$ or $—CH_2{+}NR_3R_4R_5X^-$, wherein $R_3$, $R_4$ and $R_5$ are alkyl and/or hydroxyalkyl groups with 1–4 carbon atoms and X is an anion, and n is 40–200.

11. A slurry as claimed in claim 1, characterized in that the nonionic surface active agent has the general formula $RO(CH_2CH_2O)_nH$, wherein R denotes an aliphatic or acyl group comprising 10–24 carbon atoms or a substituted aryl group comprising 12–54 carbon atoms, n is 40–200, and the ratio of ethyleneoxy units to the number of carbon atoms in the group R is 3.5–6.0 when R is an aliphatic or acyl group and 3.0–5.5 when R is a substituted aryl group.

12. A slurry as claimed in claim 11, wherein n is 50–150.

13. A process as claimed in claim 7, characterized in that the ionic surface active agent has the general formula

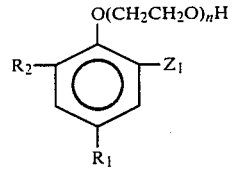

wherein $R_1$ and $R_2$ are hydrogen or an alkyl group with 1–22 carbon atoms, provided that the sum of the number of carbon atoms of $R_1$ and $R_2$ is at least 6, and $Z_1$ designates the group $—SO_3H$, $—CH_2{+}NHR_3R_4X^-$ or $—CH_2{+}NR_3R_4R_5X^-$, wherein $R_3$, $R_4$ and $R_5$ are alkyl and/or hydroxyalkyl groups with 1–4 carbon atoms and X is an anion, and n is 40–200.

14. A slurry as claimed in claim 1, characterized in that the ionic charges of the ionic surface active agent are provided by the presence therein of a group selected from the group consisting of carboxy, sulfate, sulfonate, ammonium, amine, and phosphate groups.

15. A process as claimed in claim 7, wherein the ionic charges of the ionic surface active agent are provided by the presence therein of a group selected from the group consisting of carboxy, sulfate, sulfonate, ammonium, amine, and phosphate groups.

16. A slurry as claimed in claim 1, wherein the ionic surface-active agent is present in an amount of 0.1 to 33% by weight of the total amount of surface-active agents present.

17. A slurry as claimed in claim 1, wherein the ionic surface-active agent is present in an amount of 0.5 to 25% by weight of the total amount of surface-active agents present.

* * * * *

UNITED STATES PATENT AND TRADEMARK OFFICE

CERTIFICATE OF CORRECTION

PATENT NO. : 4,549,881

DATED : October 29, 1985

INVENTOR(S) : Mait M. Mathiesen, Lars I. Gillberg, Karl M. E. Hellsten and Gunvor B. T. Karlsson It is certified that error appears in the above-identified patent and that said Letters Patent is hereby corrected as shown below:

Title Page, [75] Inventors:, line 3; "ÖdsmÅl" should read -- Ödsmål --

Title Page, [73] Assignees:, first and second lines; "Ab" should read -- AB -- in both instances -

Frame 415

Col. 2, line 1; "example" should read -- example, --

Col. 4, line 50; "pump-ability" should read -- pumpability --

Col. 9, line 8; "wherein the" should read -- wherein, in the --

Col. 13, line 24; "cse," should read -- case, --

Col. 17, line 25; "$CH_3$ $CH_3SO_4$-" the group "$CH_3$" and the radical "$CH_3SO_4$-" should not be as one. Move the radical "$CH_3SO_4$-" over about ten (10) spaces to the right Signed and Sealed this Eighth Day of April 1986

[SEAL]

Attest:

DONALD J. QUIGG

Attesting Officer

Commissioner of Patents and Trademarks